US008330346B2

(12) United States Patent
Kawai et al.

(10) Patent No.: US 8,330,346 B2
(45) Date of Patent: Dec. 11, 2012

(54) IMAGE DISPLAY DEVICE

(75) Inventors: Tatsundo Kawai, Yokohama (JP); Yuuji Kasanuki, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 594 days.

(21) Appl. No.: 12/572,183

(22) Filed: Oct. 1, 2009

(65) Prior Publication Data

US 2010/0090584 A1 Apr. 15, 2010

(30) Foreign Application Priority Data

Oct. 10, 2008 (JP) ..... 2008-264348
Sep. 18, 2009 (JP) ..... 2009-217327

(51) Int. Cl.
*H01J 63/04* (2006.01)
*H01J 63/00* (2006.01)

(52) U.S. Cl. ..... 313/496; 313/495; 313/497

(58) Field of Classification Search ..... 313/309–311, 313/495–497

See application file for complete search history.

(56) References Cited

U.S. PATENT DOCUMENTS

| | | | | |
|---|---|---|---|---|
| 5,811,924 | A | 9/1998 | Okumura | |
| 6,037,711 | A * | 3/2000 | Cathey et al. | 313/497 |
| 6,762,553 | B1 | 7/2004 | Yokogawa | |
| 2004/0173780 | A1 * | 9/2004 | Kumar | 252/500 |

FOREIGN PATENT DOCUMENTS

| | | | |
|---|---|---|---|
| JP | 10-208659 | A | 8/1998 |
| JP | 2005-082707 | A | 3/2005 |
| JP | 2007-177156 | A | 7/2007 |

OTHER PUBLICATIONS

Do et al., "Improved Cathodolumineacence Output Coupling of ZnS:Tb Thin-Film Phosphors Deposited on 2D SiO2 corrugated glass substrate", Journal of the Electrochemical Society, 150 (11) H260-H265 (2003).*

Improved Cathodoluminescence Output Coupling of ZnS:Tb Thin-Film Phosphors Deposited on 2D SiO2 Corrugated Glass Substrate.

* cited by examiner

*Primary Examiner* — Joseph L Williams
*Assistant Examiner* — Nathaniel Lee
(74) *Attorney, Agent, or Firm* — Canon USA Inc IP Division

(57) ABSTRACT

An image display device includes a rear plate provided with an electron emitting element, a face plate provided with a transparent substrate, a transparent anode electrode formed on the transparent substrate, and a fluorescent layer provided on the anode electrode and including fluorescent particles. An average particle size of the fluorescent particles is equal to or less than 500 nm. The face plate has a light extraction means for extracting light emitted when the fluorescent layer is irradiated by electrons emitted from the electron emitting element to the substrate side.

4 Claims, 7 Drawing Sheets

IMAGE DISPLAY DEVICE

BACKGROUND OF THE INVENTION

1. Field of the Invention

The present invention relates to an image display device, and more particularly to a flat image display device using an electron emitting element.

2. Description of the Related Art

Cathode ray tubes (CRT) have been used as displays using electron beams. In a CRT, image display is performed by irradiating a fluorescent substance with an electron beam emitted from an electron gun and accelerated by an anode electrode and causing the fluorescent substance to emit light. Fluorescent particles with a diameter of about several micrometers have been used as the fluorescent substance employed in the CRT.

Meanwhile, a field emission display (FED) has been developed as a flat image display device using an electron emitting element. In the FED, similarly to the CRT, image display is performed by irradiating a fluorescent substance with an electron beam emitted from an electron emitting element and accelerated by an anode electrode and causing the fluorescent substance to emit light. However, in the FED, by contrast with the CRT, a high anode voltage is difficult to apply to the anode electrode. As a result, in a case where a fluorescent substance with a particle size of about several micrometers, such as used in the CRT, is used in the FED, a sufficient emission luminance is difficult to obtain.

Accordingly, a feature of using a fluorescent substance in the form of nanoparticles as the fluorescent substrate for FED has been suggested (Japanese Patent Laid-Open No. 2007-177156).

SUMMARY OF THE INVENTION

The present invention provides an image display device that the luminance of the image display device using an electron emitting element is increased.

The image display device in accordance with the invention has a rear plate provided with an electron emitting element and a face plate provided with a transparent substrate, a transparent anode electrode formed on the transparent substrate, and a fluorescent layer provided on the anode electrode and including fluorescent particles, wherein an average particle size of the fluorescent particles is equal to or less than 100 nm, and the face plate has light extraction means for extracting light emitted when the fluorescent layer is irradiated by electrons emitted from the electron emitting element to the substrate side.

In accordance with the invention, it is possible to increase the luminance of an image display device using an electron emitting element.

Further features of the present invention will become apparent from the following description of exemplary embodiments (with reference to the attached drawings).

DESCRIPTION OF THE EMBODIMENTS

First Embodiment

Structure of Image Display Device

An image display device having an electron emitting element of the present embodiment will be described below with reference to FIG. 1.

Figure 1:
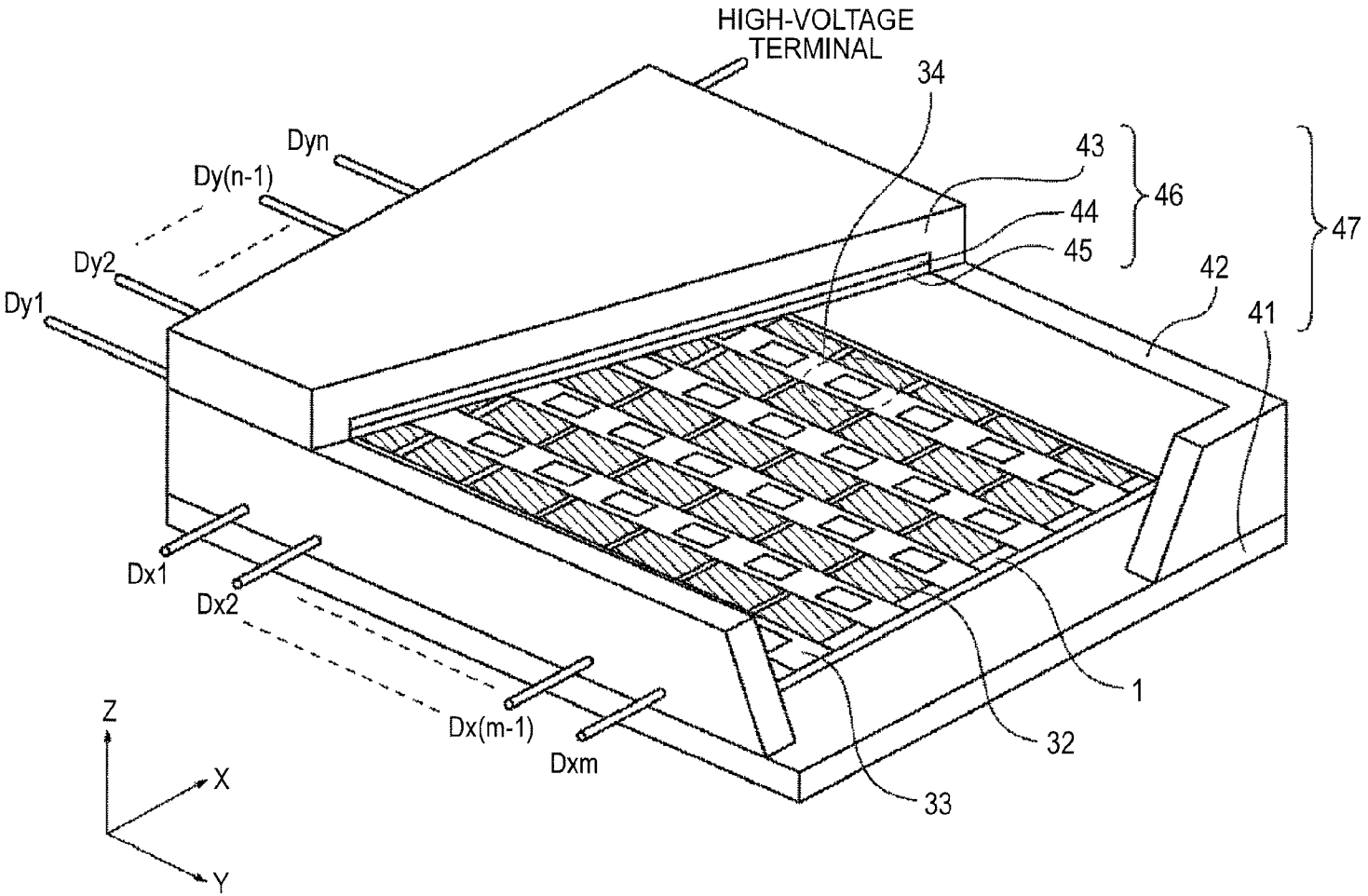
FIG. 1 is a perspective view illustrating an example of the structure of an image display device.

FIG. 1 is a perspective view illustrating an example of the structure of an image display device of the present embodiment, a part being cut out to show the internal structure. In FIG. 1, the reference numeral 1 stands for a substrate, 32—a scanning wiring, 33—a modulation wiring, 34—an electron emitting element, 41—a rear plate having the substrate 1 fixed thereto, and 46—a face plate in which an anode electrode 44 and a fluorescent layer 45 are formed on the inner surface of a glass substrate 43. The reference numeral 42 stands for a support frame. The rear plate 41 and face plate 46 are attached via frit glass or the like to the support frame 42, thereby constituting an envelope 47. In this configuration, the rear plate 41 is provided mainly to reinforce the substrate 1. Therefore, in a case where the substrate 1 itself has a sufficient strength, a separate rear plate 41 becomes unnecessary. Further, a configuration imparted with a sufficient strength with respect to atmospheric pressure can be obtained by disposing a support body (not shown in the figure) called a spacer between the face plate 46 and the rear plate 41.

A total of m scanning wirings 32 are connected to terminals Dx1, Dx2, . . . Dxm. A total of n modulation wirings 33 are connected to terminals Dy1, Dy2, . . . Dyn (m and n are positive integers). An interlayer insulating layer (not shown in the figure) is provided between these m scanning wirings 32 and n modulation wirings 33 for electric insulation thereof.

A high-voltage terminal is connected to the anode electrode 44 to supply, for example, a DC voltage of several kilovolts. This voltage is an accelerating voltage for imparting the electrons emitted from the electron emitting element with energy sufficient to excite the fluorescent substance. Image display is performed by irradiating a fluorescent substance with an electron beam emitted from an electron gun and accelerated by an anode electrode and causing the fluorescent substance to emit light.

Structure of Face Plate

Figure 2A:
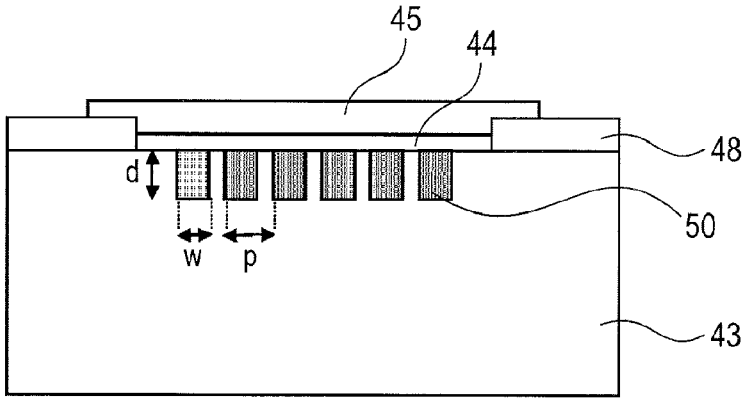
FIGS. 2A to 2C show an example of the structure of a face plate.
Figure 2B:
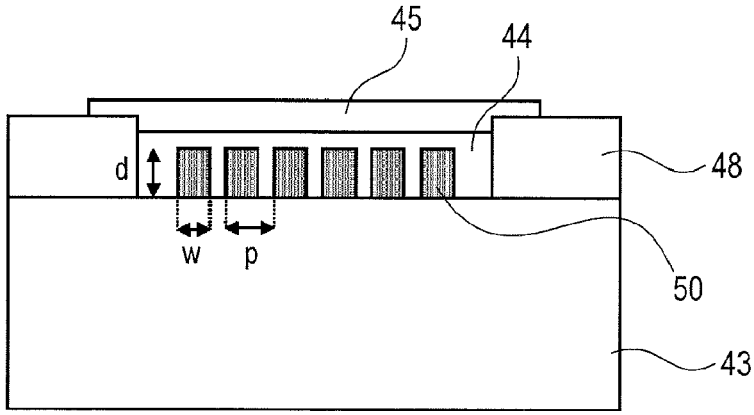
Figure 2C:
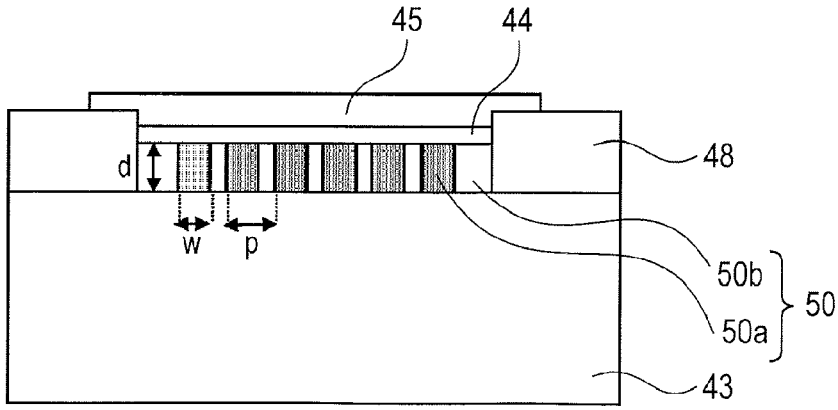

FIGS. 2A to 2C show examples of the structure of the face plate of the present embodiment.

In the face plate of the present embodiment, a light extraction means 50 that extracts the light emitted by the fluorescent layer 45 to the glass substrate 43 side is provided at the glass substrate 43 serving as a transparent substrate. The detailed structure of the light extraction means 50 will be described below. The anode electrode 44 composed of a transparent electrode such as ITO is provided on the glass substrate 43. The fluorescent layer 45 is provided on the anode electrode 44. The fluorescent layer 45 includes a large number of fluorescent particles. The detailed configuration of the fluorescent layer 45 will be described below. A black matrix 48 is provided between the adjacent fluorescent layers.

Fluorescent Layer

A method for manufacturing the fluorescent particles of the present embodiment will be described below. An average size of the fluorescent particles is equal to or less than 500 nm. The fluorescent particles are preferably nanoparticles. The average size of nanoparticles in the present embodiment is equal to or less than 100 nm. In the present invention, the "average particle size" is defined by the median diameter (i.e., the median value D50 of the particle size distribution), and can be obtained statistically from the particle size distribution (particle diameter distribution) based on the sphere equivalent diameter. The particle size distribution is measured by the dynamic light scattering method. The refractive index of the fluorescent layer 45 is measured by ellipsometry. In other words, the refractive index of the fluorescent layer 45 is not the refractive index of the fluorescent particles constituting the fluorescent layer 45 (i.e., the refractive index inherent to the fluorescent material), but is the effective refractive index of the fluorescent layer 45 as a whole, which is constituted by agglomerating the numerous fluorescent particles.

Examples of methods that can be used for manufacturing the fluorescent particles include a solid-phase method, a liquid-phase method, a spray pyrolysis method, and a vapor-phase method.

With the solid-phase method, starting material powders are mixed, heated and fired under high-temperature conditions, and the product is finely ground in a ball mill or the like to form fluorescent particles. With the liquid-phase method, fluorescent particles are formed by using a liquid-phase reaction such as co-precipitation method or a sol-gel method. With the spray pyrolysis method, a starting material solution is sprayed and converted into droplets, and the droplets are heated with a heater in a carrier gas and then forming fluorescent particles by evaporation of the solvent and thermal decomposition of starting materials. With the vapor-phase method, fluorescent particles are formed using a vapor-phase reaction. With this method fluorescent particles are formed by passing a fluorescent starting material suspended in a carrier gas through a heating zone created by a heat source such as plasma and rapidly heating and cooling the fluorescent starting material atmosphere.

In nanoparticles of a fluorescent substance emitting red light, for example, an oxide such as $Y_2O_3$ and $Gd_2O_3$ is used as a matrix and an activator metal such as Eu and Zn is added to the matrix. An inorganic salt of Y or an inorganic salt of Gd, an inorganic salt of Eu or an inorganic salt of Zn, and an organic acid are dissolved or dispersed in a solvent. The solution or dispersion thus obtained is then heated and gelled. Then, firing is conducted, for example, in the atmosphere.

Compounds that can decompose and become oxides on firing may be used as the inorganic salt of Y and inorganic salt of Gd. Examples of such compounds include nitrates, carbonates, oxalates, sulfates, acetates, hydroxides, and halides (for example, chlorides and bromides).

Examples of inorganic salts of Eu and Zn include nitrates, carbonates, oxalates, sulfates, acetates, hydroxides, and halides (for example, chlorides and bromides).

In nanoparticles of a fluorescent substance emitting green light, an oxide such as $Y_2O_3$ and $Gd_2O_3$ is used as a matrix and an activator metal such as Tb and Zn is added to the matrix. An inorganic salt of Y or an inorganic salt of Gd, an inorganic salt of Tb or an inorganic salt of Zn, and an organic acid are dissolved or dispersed in a solvent. The solution or dispersion thus obtained is then heated and gelled. Then, firing is conducted, for example, in the atmosphere.

Compounds that can decompose and become oxides on firing may be used as the inorganic salt of Y and inorganic salt of Gd. Examples of such compounds include nitrates, carbonates, oxalates, sulfates, acetates, hydroxides, and halides (for example, chlorides and bromides).

Compounds that can produce Tb and Zn as the activator metals on firing may be used as the inorganic salt of Tb and inorganic salt of Zn. Examples of such compounds include nitrates, carbonates, oxalates, sulfates, acetates, hydroxides, and halides (for example, chlorides and bromides).

In nanoparticles of a fluorescent substance emitting blue light, an oxide such as $Y_2O_3$ and $Gd_2O_3$ is used as a matrix and an activator metal such as Tm, Bi, and Zn is added to the matrix. An inorganic salt of Y or an inorganic salt of Gd, an inorganic salt of Tm, an inorganic salt of Bi, and an inorganic salt of Zn, and an organic acid are dissolved or dispersed in a solvent. The solution or dispersion thus obtained is then heated and gelled. Then, firing is conducted, for example, in the atmosphere.

Compounds that can decompose and become oxides on firing may be used as the inorganic salt of Y and inorganic salt of Gd. Examples of such compounds include nitrates, carbonates, oxalates, sulfates, acetates, hydroxides, and halides (for example, chlorides and bromides).

Examples of inorganic salts of Tm, Bi, and Zn include nitrates, carbonates, oxalates, sulfates, acetates, hydroxides, and halides (for example, chlorides and bromides).

Light Extraction Means

In the present embodiment, a photonic crystal structure 50 is used, as shown in FIG. 2A, as the light extraction means. The photonic crystal structure is a structure in which materials with mutually different refractive indexes are disposed alternately. In the photonic crystal structure, it is preferred that the materials with mutually different refractive indexes are periodically arranged. A method for manufacturing the photonic crystal structure 50 will be described below.

First, a resist film is coated on a quartz substrate. The refractive index of the quartz substrate is 1.46. Then, exposure is conducted with an exposure apparatus, followed by development, and a microhole pattern of a two-dimensional square lattice shape is formed. Here, p is a pitch of microholes and w is a diameter of a microhole. Microholes are formed as a two-dimensional square lattice by a reactive ion etching method (RIE method). Then, the resist film is stripped with a resist stripping solution. A $TiO_2$ film is then deposited by a chemical vapor deposition method (CVD method) using titanium tetrachloride. The refractive index of the $TiO_2$ film is 2.2 and higher than that of the quartz substrate. Annealing is then performed. Surface polishing is thereafter conducted by a chemical mechanical polishing method (CMP method). The transparent substrate 43 provided with the photonic crystal structure 50 is thus formed.

The transparent anode electrode 44 is then formed on the transparent substrate 43 (on the photonic crystal structure 50). The transparent anode electrode 44 is formed by depositing a transparent conductive film such as an ITO film, a ZnO film, or a SnO film. The refractive index of the transparent conductive film is typically within a range of 1.8-2.2. The fluorescent layer 45 is then formed on the anode electrode 44. The refractive index of the fluorescent layer 45 is lower than that of the anode electrode 44. In other words, the refractive index of the anode electrode 44 is higher than that of the fluorescent layer 45. The refractive index of the fluorescent layer 45 can be also set by controlling the filling ration of the fluorescent particles. In a case where the photonic crystal structure 50 is used as the light extraction means as in the present embodiment, the increase of luminance owing to the photonic crystal structure is influenced by the refractive index of the fluorescent layer 45. In a case where the refractive index of the fluorescent layer 45 is higher than the refractive index of the anode electrode 44, light generated in the fluorescent layer 45 is totally reflected at the interface between the fluorescent layer 45 and the anode electrode 44 to cause light that is not incident on the photonic crystal structure 50. Accordingly, the emission luminance may decrease. In a case where the refractive index of the fluorescent layer 45 is lower than the refractive index of the anode electrode 44, on the other hand, light generated in the fluorescent layer 45 is incident on the photonic crystal structure 50 with substantially no total reflection at the interface between the fluorescent layer 45 and the anode electrode 44 and is extracted to the air. Accordingly, the luminance can be increased.

With the photonic crystal structure 50 using a structure in which materials with mutually different refractive indexes are alternately disposed in a plane parallel to the fluorescent layer 45, it is possible to extract a larger amount of the light emitted by the fluorescent layer 45 to the transparent substrate 43 side. Here, a configuration is explained in which the photonic crystal structure 50 is provided in the transparent substrate 43, but the photonic crystal structure may be also provided in the anode electrode 44, as shown in FIG. 2B. Further, the photonic crystal structure 50 constituted by the mutually different materials 50*a* and 50*b* may be also provided between the anode electrode 44 and transparent substrate 43, as shown in FIG. 2C. In other words, the photonic crystal structure 50 may be provided between the outer surface of the transparent substrate 43 and the fluorescent layer 45. The outer surface of the transparent substrate 43 is a surface opposite to a inner surface where the anode electrode and the fluorescent layer 45 are provided. In particular, it is preferred that the photonic crystal structure 50 constituted by the mutually different materials 50*a* and 50*b* that differ from both the material of the substrate 43 and the material of the anode electrode 44 be provided between the anode electrode 44 and transparent substrate 43.

Second Embodiment

In the first embodiment, the photonic crystal structure 50 is used as the light extraction means, whereas in the present embodiment, a low-refractive layer is used. Because other features are identical to those of the first embodiment, only the light extraction means using the low-refractive layer will be explained below.

Light Extraction Means

Figure 4:
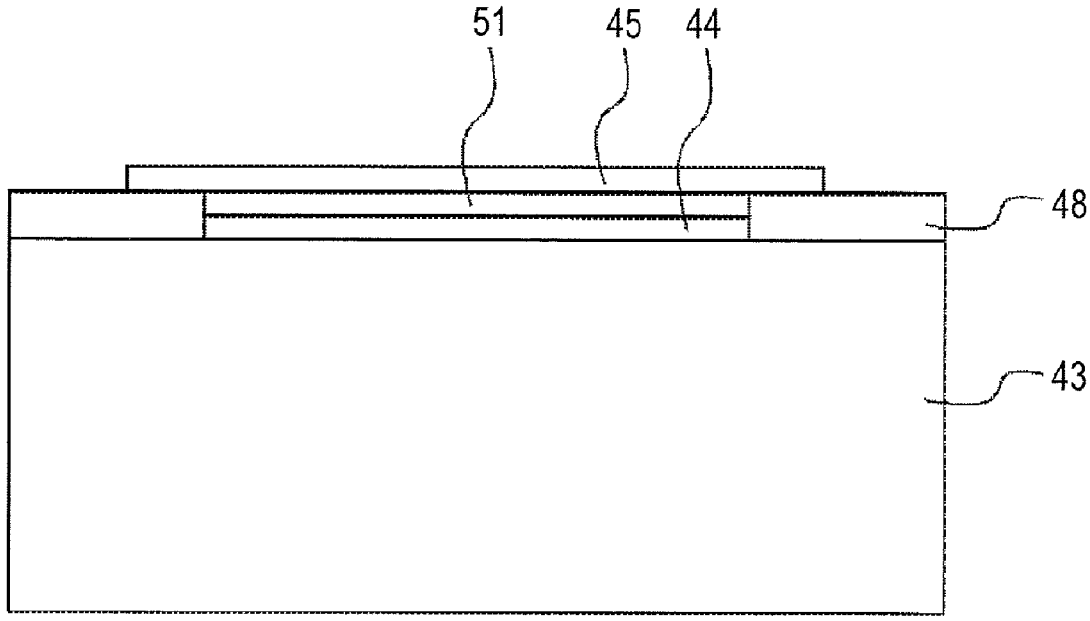
FIG. 4 shows an example of the structure of a face plate.

In the present embodiment, as shown in FIG. 4, a low-refractive layer 51 that is layer with a refractive index lower than that of the fluorescent layer 45 is provided between the anode electrode 44 and fluorescent layer 45. At this time, the thickness of the fluorescent layer 45 is made sufficiently small. The thickness of the fluorescent layer 45 is preferably such a value or less that is obtained by dividing the emission wavelength of the fluorescent layer 45 by the refractive index of the fluorescent layer 45, and is more preferably such a value or less that is obtained by dividing ½ of the emission wavelength (half wavelength) of the fluorescent layer 45 by the refractive index of the fluorescent layer 45. Further, the refractive index of the low-refractive layer 51 is preferably lower than that of the anode electrode 44. When the thickness of the fluorescent layer 45 is sufficiently small with respect to the emission wavelength of the fluorescent layer 45, geometric optical approximation is not applied to incidence and reflection at the interface between the fluorescent layer 45 and the low-refractive layer 51. Accordingly, light emitted from the fluorescent layer 45 having a higher refractive index than that of the low-refractive layer 51 invades the low-refractive layer 51 without inhibition by total reflection at the interface between the fluorescent layer 45 and the low-refractive layer 51. When the light exits the low-refractive layer 51 and is radiated from the outer surface of the substrate 43 through the anode electrode 44 and the substrate 43, the light behaves as if it is emitted in the low-refractive layer 51. Accordingly, it is possible to decrease the amount of light that is inhibited from being radiated from the outer surface of the substrate 43 by total reflection at the interface between the substrate 43 and the air, and thus high luminance can be achieved. In this embodiment, although a configuration in which the refractive index of the fluorescent layer 45 is higher than that of the anode electrode 44 is especially effective, a configuration in which the refractive index of the fluorescent layer 45 is lower than that of the anode electrode 44 is effective.

The low-refractive layer 51 can be formed by spin coating a low-refractive material on the anode electrode 44. For example, a hydrophobic porous silica material such as a liquid substance having a low specific dielectric constant that contains water-repellent hexamethyldisiloxane or hexamethyldisilazane can be used as the low-refractive material. Further, inorganic materials such as silica compounds, titanium compounds, tin compounds, indium compounds, and zirconium compounds and organic materials such as acrylic resins, polyester resins, vinyl chloride resins, and epoxy resins can be also used. These materials may be used individually or in combinations of two or more thereof. After the spin coating process, firing is performed and components other than the low-refractive material are evaporated and removed.

EXAMPLES

Example 1

Fluorescent Nanoparticles

Figure 5:
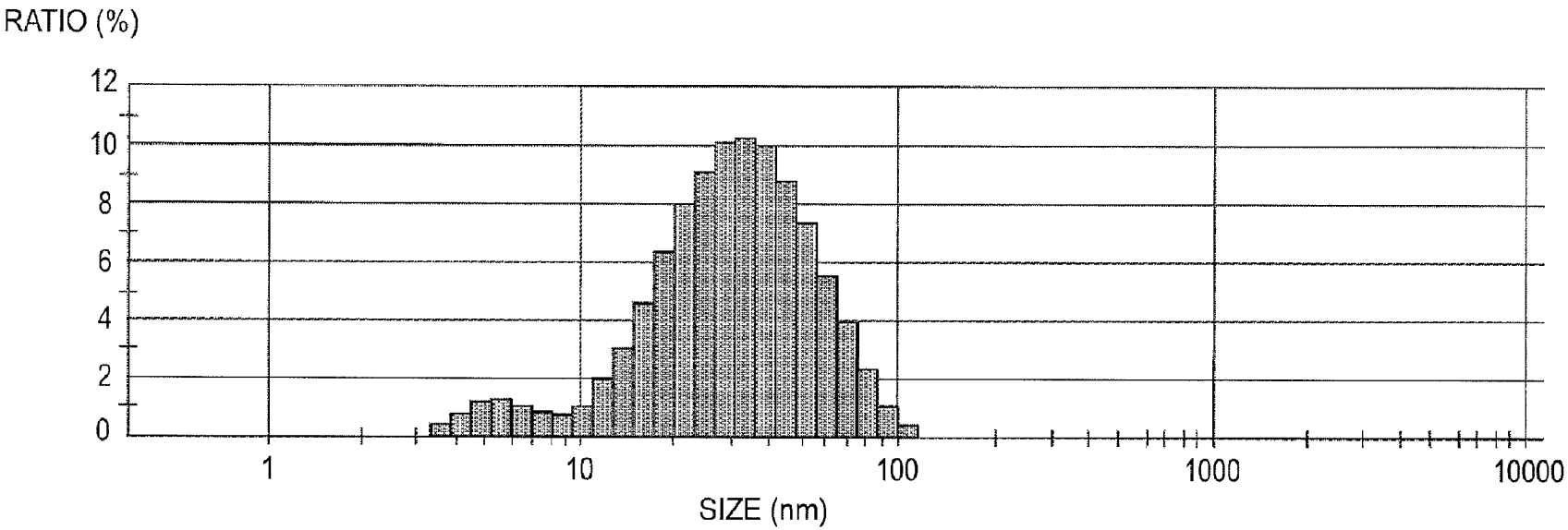
FIG. 5 shows particle size distribution of fluorescent nanoparticles.

Nanoparticles of $Y_2O_3$:Eu that emit red light were produced using a sol-gel method. FIG. 5 shows the results obtained in measuring the particles size distribution of fluorescent particles of the present embodiment. The nanoparticles had an average size of 30 nm. The particle size distribution and average size of the fluorescent particles were measured with Zetasizer Nano ZS (manufactured by Sysmex).

The nanoparticles obtained by the sol-gel method were placed in a ball mill, and a solvent dispersion treatment was performed. IPA (isopropyl alcohol) was used as the solvent, and an acrylic dispersant was used as the dispersant.

Solvent substitution was then performed with BCA (butyl carbitol acetate) to impart viscosity and surface tension suitable for an ink jet method, and ink-jet ink that contained the fluorescent nanoparticles was prepared.

Light Extraction Means

In the present embodiment a photonic crystal structure 50 was formed as the light extraction means.

Figure 3:
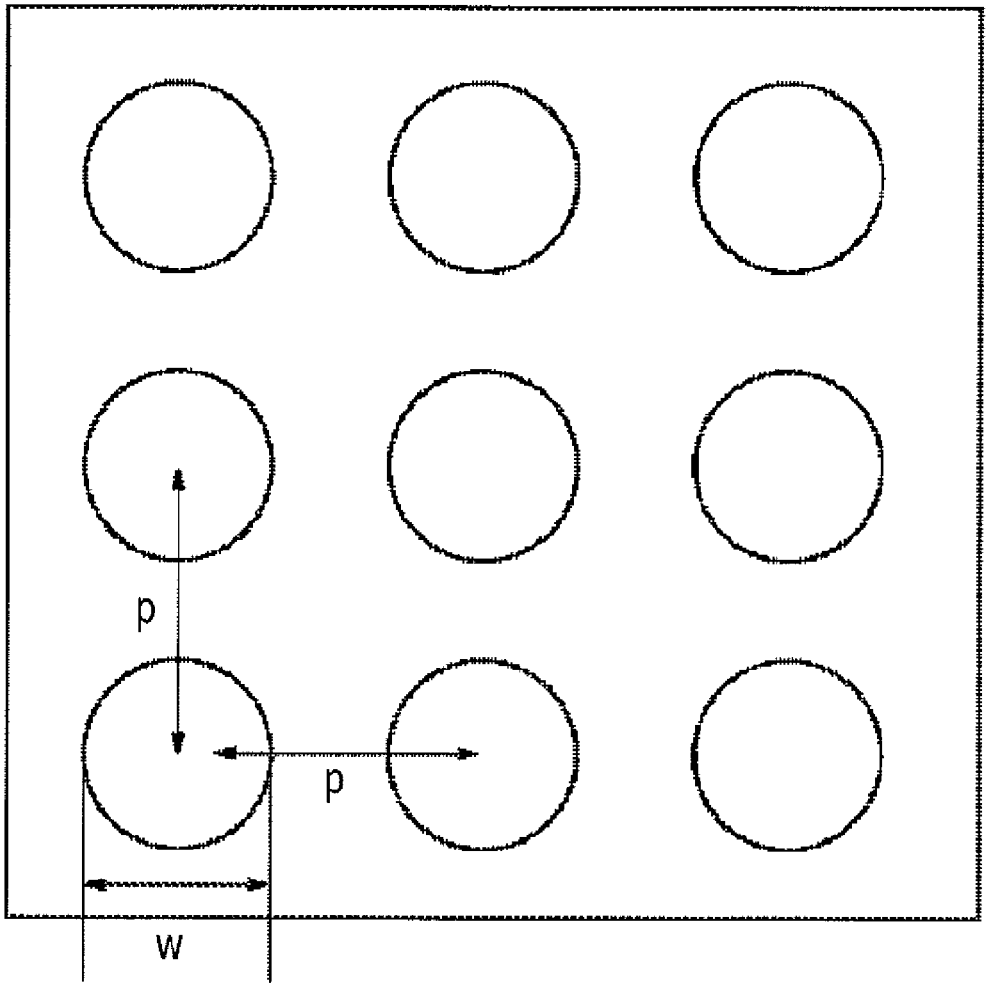
FIG. 3 is a plan view of a photonic crystal structure.

First, as shown in FIG. 3, a microhole pattern of a two-dimensional square lattice shape was formed on a quartz substrate. Here, the pitch p of microholes was 1700 nm, the diameter w of a microhole was 920 nm, and the depth of microholes was 880 nm. The refractive index of the quartz substrate was 1.46.

A $TiO_2$ film was then deposited by a chemical vapor deposition method (CVD method) by using titanium tetrachloride. The refractive index of the $TiO_2$ film was 2.2. Annealing was then performed.

Surface polishing was thereafter conducted by a chemical mechanical polishing method (CMP method). The depth d of microholes after the surface polishing was 670 nm.

Face Plate

An ITO film as an anode electrode 44 was deposited to a thickness of 250 nm by using a sputtering method on the substrate 43 having the above-described photonic crystal structure 50. The refractive index of the ITO film was 1.9.

The ink-jet ink containing the above-described fluorescent nanoparticles was then discharged using an ink jet method onto the surface of the ITO film. Firing was thereafter conducted for 1 hour at a temperature of 550° C. The thickness of the fluorescent layer 45 after firing was 820 nm. The refractive index of the fired fluorescent layer 45 was measured with Ellipsometer VASE (manufactured by J. A. Woollam Japan Co.). The result was 1.3.

The surface and cross section of the face plate formed in the above-described manner were observed under a scanning electron microscope. The results obtained confirmed that fluorescent particles with a diameter of equal to or less than 100 nm, that is, the nanoparticles, have aggregated in the fluorescent layer 45. Further, clearly seen gaps were observed between the nanoparticles. The filling ratio of the fluorescent particles was found from the mass of the fluorescent particles contained in the discharged liquid droplets of the ink-jet ink, amount of discharged ink, and thickness of the fired fluorescent layer measured with a contact step meter. The result was 38%. The filling ratio was also separately measured by a method by which the number of yttrium atoms in the fired fluorescent layer was measured using an electron beam microanalyzer (EPMA) and the result was recalculated as a density by using the aforementioned thickness of the fluorescent layer. The result obtained matched well a value of 38% that was obtained by the above-described calculation method.

Image Display Device

An image display device was formed using the face plate 46 formed in the above-described manner, a rear plate 41 having an electron emitting element, and a support frame 42. An electron emitting element of a surface conduction type was used as the electron emitting element.

Luminance Measurement

The emission luminance of the image display device formed in the above-described manner was measured.

The degree of vacuum inside the image display device was set to $1\times10^{-6}$ Pa, and an anode voltage of 10 kV was applied to the anode electrode 44. A drive pulse of a pulse width of 20 μsec and a pulse frequency of 100 Hz was applied to the electron emitting element and electrons were emitted from the electron emitting element 34. The pulse current density was 4.1 mA/cm$^2$.

Figure 6:
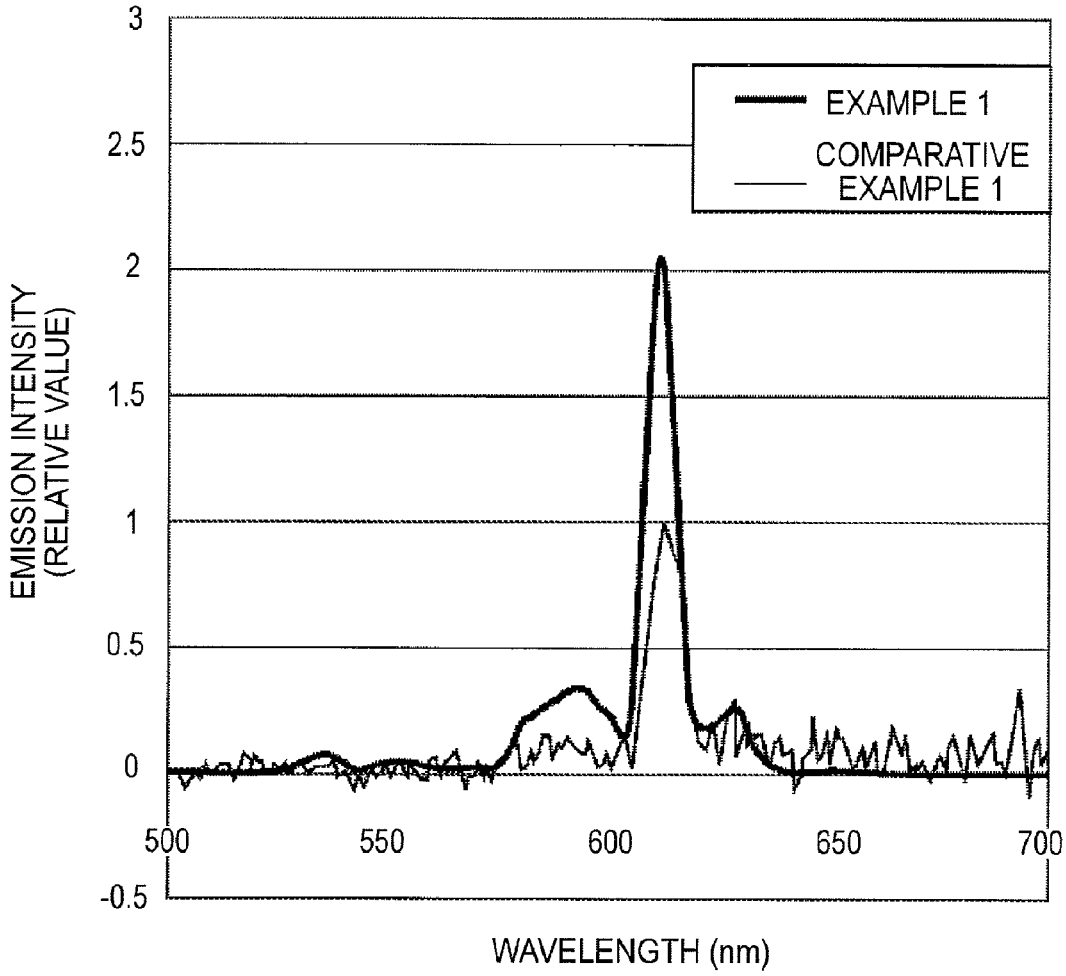
FIG. 6 shows measurement results relating to emission luminance.

The measurement results relating to luminance of emission from the fluorescent layer are shown in FIG. 6. A wavelength (nm) is plotted against the abscissa, and an emission intensity is plotted against the ordinate. The value of emission intensity is a relative value for which the maximum value of emission intensity in the below-described Comparative Example 1 was taken as a reference.

The maximum value of emission intensity in the present embodiment was 2.1 times the maximum value of emission intensity in the below-described Comparative Example 1.

Comparative Example 1

The configuration of Comparative Example 1 was different in that the photonic crystal structure 50 serving as the light extraction means in Embodiment 1 was not formed. Thus, the difference between this comparative example and Embodiment 1 was in that an ITO film was formed on the quartz substrate, without forming the photonic crystal structure 50 in the quartz substrate. Other features are identical to those of Embodiment 1.

The results obtained in measuring the emission luminance of the image display device formed in the above-described manner are shown in FIG. 6. The emission luminance in the present comparative example was much lower than that of Embodiment 1 because no light extraction means was provided.

Example 2

Figure 7A:
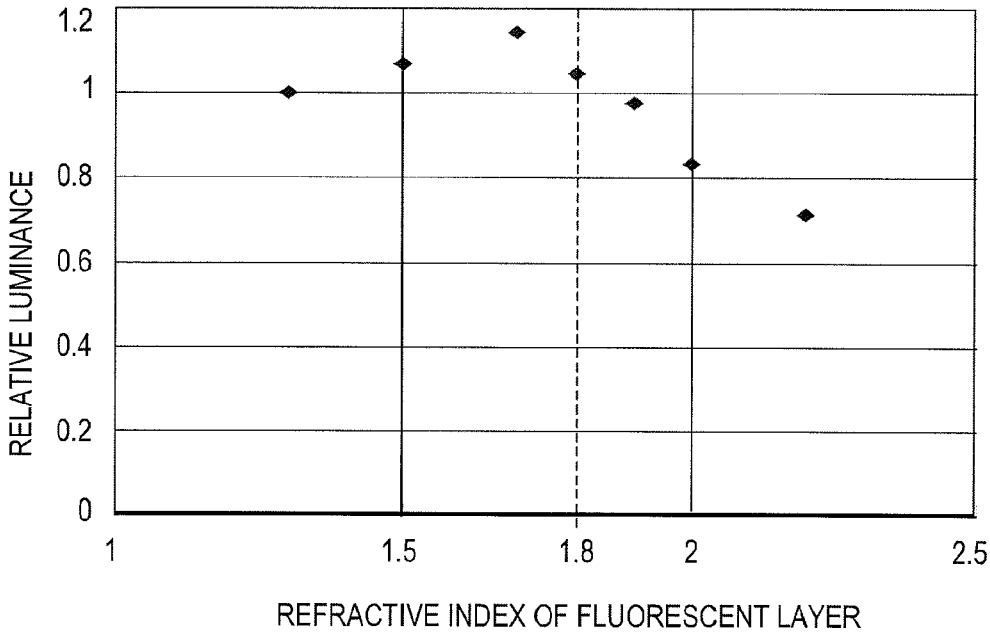
FIG. 7A shows relationship between refractive index of the fluorescent layer and emission luminance.

With regard to the image display device used in Example 1, replacing a refractive index of the anode electrode 44 by 1.8 instead of ITO, the change of the emission luminance on changing the refractive index of the fluorescent layer 45 was obtained by simulation. The simulation results are shown in FIG. 7A. It was understood that in a range of the refractive index of the fluorescent layer 45 of from 1.3 to 1.7, the emission luminance was increased by increasing the refractive index, whereas the emission luminance was decreased by increasing the refractive index when the refractive index of the fluorescent layer 45 exceeded 1.8, which was the refractive index of the anode electrode 44. Accordingly, the refractive index of the fluorescent layer 45 is preferably lower than the refractive index of the anode electrode 44. The difference between the refractive index of the fluorescent layer 45 providing the maximum luminance (1.7) and the refractive index of the anode electrode 44 (1.8) is 0.1 herein, and the difference varies depending on the photonic crystal structure and the refractive index of the anode electrode 44.

The refractive index of the fluorescent layer 45 (i.e., the effective refractive index) depends on the refractive index of the fluorescent particles (i.e., the refractive index inherent to the fluorescent material). However, the fluorescent layer 45 of the present invention uses fluorescent particles having an average particle size equal to or less than 500 nm, and therefore the refractive index of the fluorescent layer 45 can be controlled by changing the filling ratio of the fluorescent particles in the fluorescent layer 45 with the particle size distribution of the fluorescent particles, the ink concentration, the dispersion conditions, the baking conditions or the like.

While the refractive index of fluorescent particles that are ordinarily used in an image display device is approximately from 1.6 to 2.6, fluorescent particles having a refractive index higher than that of the anode electrode 44 are used preferably to make the refractive index of the fluorescent layer 45 lower than the refractive index of the anode electrode 44 by controlling the filling ratio.

Figure 7B:
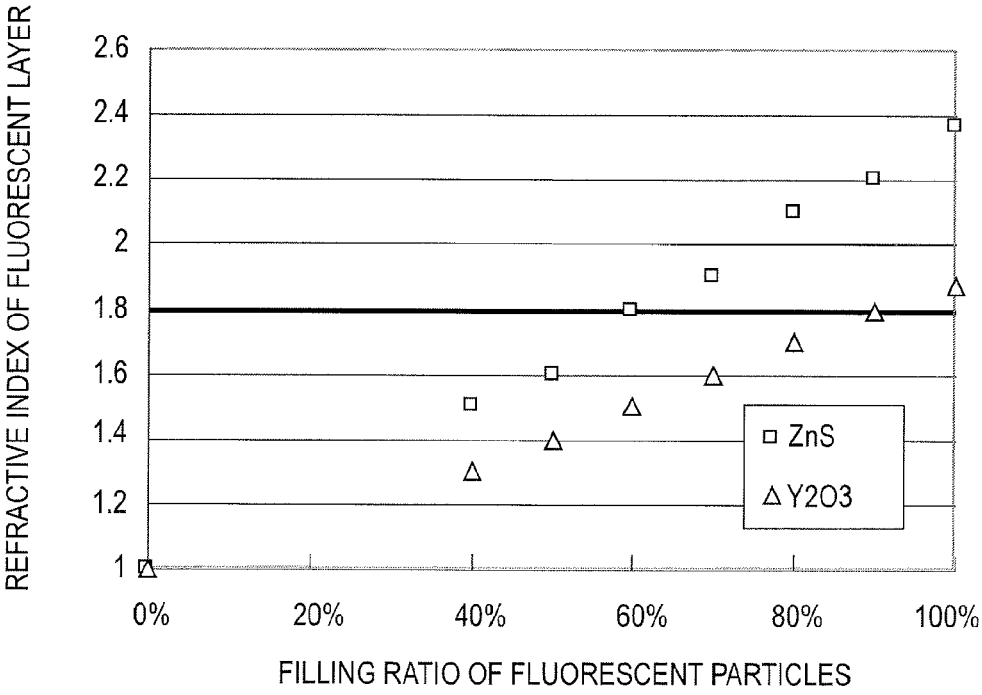
FIG. 7B shows relationship between filling ratio of fluorescent particles and refractive index of the fluorescent layer.

The relationship between the filling ratio of the fluorescent particles in the fluorescent layer 45 and the refractive index of the fluorescent layer 45 was calculated based on the Bruggman's equation for $Y_2O_3$:Eu having a refractive index of 1.9 inherent to the material exemplified in Example 1 and ZnS having a refractive index of 2.4 inherent to the material exemplified as an ordinary fluorescent material. The results are shown in FIG. 7B. The Bruggman's equation is as follows:

$$0 = f_a \frac{\varepsilon_a - \varepsilon}{\varepsilon_a + 2\varepsilon} + f_b \frac{\varepsilon_b - \varepsilon}{\varepsilon_b + 2\varepsilon}$$

wherein $\in$ represents the effective dielectric constant of the layer, $\in_a$ represents the dielectric constant of the substance a, $f_a$ represents the volume fraction of the substance a in the layer, $\in_b$ represents the dielectric constant of the substance b, and $f_b$ represents the volume fraction of the substance b in the layer. The refractive index of the fluorescent layer is obtained as $\sqrt{\in}$ assuming that the substance a is the fluorescent particles, the substance b is vacuum, $f_a$ is the filling ratio of the fluorescent particles in the fluorescent layer, $f_b$ is the void fraction of the fluorescent layer ($f_b$=1−$f_a$), and the magnetic permeability of the fluorescent particles is 1. The refractive index inherent to the material agrees with the refractive index with $f_b$=0.

It is understood from FIG. 7B that in a case where the $Y_2O_3$ fluorescent particles are used, the refractive index of the fluorescent layer 45 can be 1.8 or less with the filling ratio in the fluorescent layer 45 of less than 90%. In particular, the refractive index of 1.7 providing the maximum emission luminance as in FIG. 7A can be attained with the filling ratio of approximately 80%.

In a case where the ZnS fluorescent particles are used, the refractive index of the fluorescent layer 45 can be 1.8 or less with the filling ratio in the fluorescent layer 45 of less than 60%. In particular, the refractive index of 1.7 providing the maximum emission luminance as in FIG. 7A can be attained with the filling ratio of approximately 50%.

While an example with the anode electrode 44 having a refractive index of 1.8 has been shown, in a case where the refractive index of the anode electrode 44 is 1.8 or more and the refractive index of the fluorescent particles is 2.4 or less, the filling ratio in the fluorescent layer 45 may be less than 60%. The filling ratio of less than 60% makes the refractive index of the fluorescent layer 45 smaller than the refractive index of the anode electrode 44. For example, in a case where ITO (refractive index: 1.9) is used as the anode electrode 44 and ZnS is used as the fluorescent particles as in Example 1, the filling ratio of the fluorescent particles may be less than 70%.

It is understood from FIGS. 7A and 7B that the emission luminance of the image display device can be increased by making the fluorescent layer 45 have a desired refractive index that is smaller than the refractive index of the anode electrode 44 with the decreased filling ratio of the fluorescent particles in the fluorescent layer 45.

Example 3

Fluorescent Nanoparticles

Similarly to Embodiment 1, nanoparticles of $Y_2O_3$:Eu that emit red light were produced using a sol-gel method. The nanoparticles had an average size of 30 nm.

The nanoparticles obtained by the sol-gel method were placed in a ball mill and a solvent dispersion treatment was performed. IPA (isopropyl alcohol) was used as the solvent, and an acrylic dispersant was used as the dispersant.

Solvent substitution was then performed with BCA (butyl carbitol acetate) to impart viscosity and surface tension suitable for an ink jet method, and ink-jet ink that contained the fluorescent nanoparticles was prepared.

Face Plate

An ITO film 44 was deposited to a thickness of 250 nm by using a sputtering method on the quartz substrate 43. The refractive index of the ITO film was 1.9.

A low-refractive layer 51 with a refractive index lower than that of the below-described fluorescent layer was then formed by a spin coating method on the ITO film 44. In the low-refractive layer 51, a liquid substance with a low specific dielectric constant that contained hexamethyldicyclohexane or hexamethyldisilazane was used as a starting hydrophobic porous silica material. The refractive index of the low-refractive layer 51 thus formed was 1.2.

The ink-jet ink containing the above-described fluorescent nanoparticles was then discharged using an ink jet method onto the surface of the low-refractive layer 51. Firing was thereafter conducted for 1 hour at a temperature of 550° C. and the fluorescent layer 45 was formed. The thickness of the fluorescent layer 45 after firing was 150 nm.

The surface and cross section of the face plate formed in the above-described manner were observed under a scanning electron microscope. The results obtained confirmed that nanoparticles with a diameter of equal to or less than 100 nm have aggregated. Further, clearly seen gaps were observed between the nanoparticles. The filling ratio of the fluorescent particles was found from the mass of the fluorescent particles contained in the discharged liquid droplets of the ink-jet ink, amount of discharged ink, and thickness of the fired fluorescent layer 45. The result was 38%. The refractive index of the fired fluorescent layer 45 was 1.3.

Image Display Device

An image display device was formed using the face plate 46 formed in the above-described manner, a rear plate 41 having an electron emission element, and a support frame 42. An electron emitting element of a surface conduction type was used as the electron emitting element.

Luminance Measurement

The emission luminance of the image display device formed in the above-described manner was measured.

The degree of vacuum inside the image display device was set to $1\times10^{-6}$ Pa, and an anode voltage of 10 kV was applied to the anode electrode 44. A drive pulse of a pulse width of 20 μsec and a pulse frequency of 100 Hz was applied to the electron emitting element and electrons were emitted from the electron emitting element 34. The pulse current density was 4.1 mA/cm$^2$.

The luminance of emission from the fluorescent layer that emitted red light was measured and confirmed to be higher than that obtained in Comparative Example 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2008-264348, filed on Oct. 10, 2008 and 2009-217327, filed on Sep. 18, 2009, which are hereby incorporated by reference herein in its entirety.

What is claimed is:

1. An image display device comprising an electron emitting element, a transparent substrate, a fluorescent layer provided on the transparent substrate and including fluorescent particles, a transparent anode electrode provided between the transparent substrate and the fluorescent layer, the fluorescent layer being irradiated by electrons emitted from the electron emitting element, wherein an average particle size of the fluorescent particles is equal to or less than 500 nm, and a refractive index of the fluorescent layer is lower than a refractive index of the anode electrode, and a structure in which materials with mutually different refractive indexes are disposed alternately is provided between the fluorescent layer and a surface of the transparent substrate that is opposite to a surface where the fluorescent layer is provided.

2. The image display device according to claim 1, wherein a refractive index of the fluorescent particles is higher than the refractive index of the anode electrode.

3. The image display device according to claim 1, wherein the average particle size of the fluorescent particles is equal to or less than 100 nm.

4. An image display device comprising an electron emitting element, a transparent substrate, a fluorescent layer provided on the transparent substrate and including fluorescent particles, a transparent anode electrode provided between the transparent substrate and the fluorescent layer, the fluorescent layer being irradiated by electrons emitted from the electron emitting element, wherein an average particle size of the fluorescent particles is equal to or less than 500 nm, and a layer with a refractive index lower than that of the fluorescent layer is provided between the fluorescent layer and the anode electrode, wherein the thickness of the fluorescent layer is a value or less that is obtained by dividing the emission wavelength of the fluorescent layer by the refractive index of the fluorescent layer.

* * * * *